US011022911B2

(12) United States Patent
Lavigne et al.

(10) Patent No.: US 11,022,911 B2
(45) Date of Patent: Jun. 1, 2021

(54) PRINT SUBSTANCE VALVES

(71) Applicant: Hewlett-Packard Development Company, L.P., Spring, TX (US)

(72) Inventors: Mathew Lavigne, Boise, ID (US); Dean Richtsmeier, Boise, ID (US); Jeff Luke, Boise, ID (US)

(73) Assignee: Hewlett-Packard Development Company, L.P., Spring, TX (US)

( * ) Notice: Subject to any disclaimer, the term of this patent is extended or adjusted under 35 U.S.C. 154(b) by 0 days.

(21) Appl. No.: 17/048,793

(22) PCT Filed: Aug. 30, 2018

(86) PCT No.: PCT/US2018/048891

§ 371 (c)(1),
(2) Date: Oct. 19, 2020

(87) PCT Pub. No.: WO2020/046347

PCT Pub. Date: Mar. 5, 2020

(65) Prior Publication Data

US 2021/0116841 A1 Apr. 22, 2021

(51) Int. Cl.

| | |
|---|---|
| ***G03G 15/06*** | (2006.01) |
| ***G03G 15/08*** | (2006.01) |
| ***G03G 9/087*** | (2006.01) |
| ***G03G 21/16*** | (2006.01) |

(52) U.S. Cl.
CPC ..... *G03G 15/0886* (2013.01); *G03G 9/08759* (2013.01); *G03G 15/0867* (2013.01); *G03G 21/1676* (2013.01)

(58) Field of Classification Search
CPC ..... G03G 9/08759; G03G 15/0865; G03G 15/0867; G03G 15/0877; G03G 15/0886; G03G 21/1676
USPC ..... 399/107, 110, 119, 120, 252, 258–263; 222/DIG. 1
See application file for complete search history.

(56) References Cited

U.S. PATENT DOCUMENTS

| | | | | |
|---|---|---|---|---|
| 6,889,026 | B2 | 5/2005 | Schlageter et al. | |
| 7,621,502 | B2 | 11/2009 | Wegman | |
| 7,805,092 | B2 | 9/2010 | Mihara | |
| 8,091,723 | B2 | 1/2012 | Li et al. | |
| 8,565,649 | B2 * | 10/2013 | Murakami | G03G 15/0872 399/258 |
| 8,755,720 | B2 * | 6/2014 | Mitani | G03G 15/0877 399/258 |
| 9,285,765 | B2 * | 3/2016 | Anan | G03G 15/0886 |
| 2010/0329734 | A1 | 12/2010 | Hayakawa et al. | |
| 2012/0219318 | A1 | 8/2012 | Yoshida et al. | |

(Continued)

FOREIGN PATENT DOCUMENTS

| | | | |
|---|---|---|---|
| EP | 1 659 455 | A2 | 5/2006 |
| JP | 4825488 | B2 | 11/2011 |

*Primary Examiner* — Hoan H Tran
(74) *Attorney, Agent, or Firm* — Jefferson IP Law, LLP

(57) ABSTRACT

Examples described herein relate to a system consistent with the disclosure. For instance, the system may comprise a valve body having a first opening, a print substance valve disposed inside of the valve body including a second opening, and a liner coupled to the print substance valve including a third opening, where the liner is to clean print substance, when present, from the system responsive to the transition of the system into either of a closed position or an open position.

15 Claims, 5 Drawing Sheets

(56) References Cited

U.S. PATENT DOCUMENTS

| | | | |
|---|---|---|---|
| 2013/0266347 | A1 | 10/2013 | Kubota et al. |
| 2016/0313674 | A1 | 10/2016 | Eto |

* cited by examiner

PRINT SUBSTANCE VALVES

BACKGROUND

Imaging systems such as printers, copiers, etc. may be used to form markings on a print medium, such as text, images, etc. Imaging systems may form markings on the print medium and/or form a three-dimensional object by employing a print substance such as an ink, toner, and/or a three-dimensional printing substance such as three-dimensional printing powders, etc.

DETAILED DESCRIPTION

Printing devices may form markings on a print medium (e.g., paper, photopolymers, plastics, composite, metal, wood, etc.) by transferring a print substance (e.g., ink, toner, etc.) from a print substance container to print medium. A system including a print substance valve may be used to refill a print substance container when the amount of print substance in the print substance container is not at capacity. The system may include a valve body to connect with the print substance container to initiate a refill process.

However, print substance residue may remain on the surface of the system after the transfer of print substance is complete. Print substance residue remaining on the surface of the system may cause the print substance residue to transfer onto the user as well as other non-intended surfaces. In addition, print substance residue remaining on the surface of the system and/or other components of the system may contaminate the print substance entering the print substance container.

As such, print substance valves, as described herein, may include a valve body, a print substance valve, and a liner to limit the amount of print substance remaining on the components and/or surface of the system. Limiting the amount of print substance remaining in the system may reduce the amount of contaminated print substance entering the print substance container. Accordingly, this disclosure describes systems including print substance valves disposed inside of a valve body and a liner coupled to the print substance valve to clean print substance, when present, from the system and the surfaces it comes in contact with.

Figure 1:
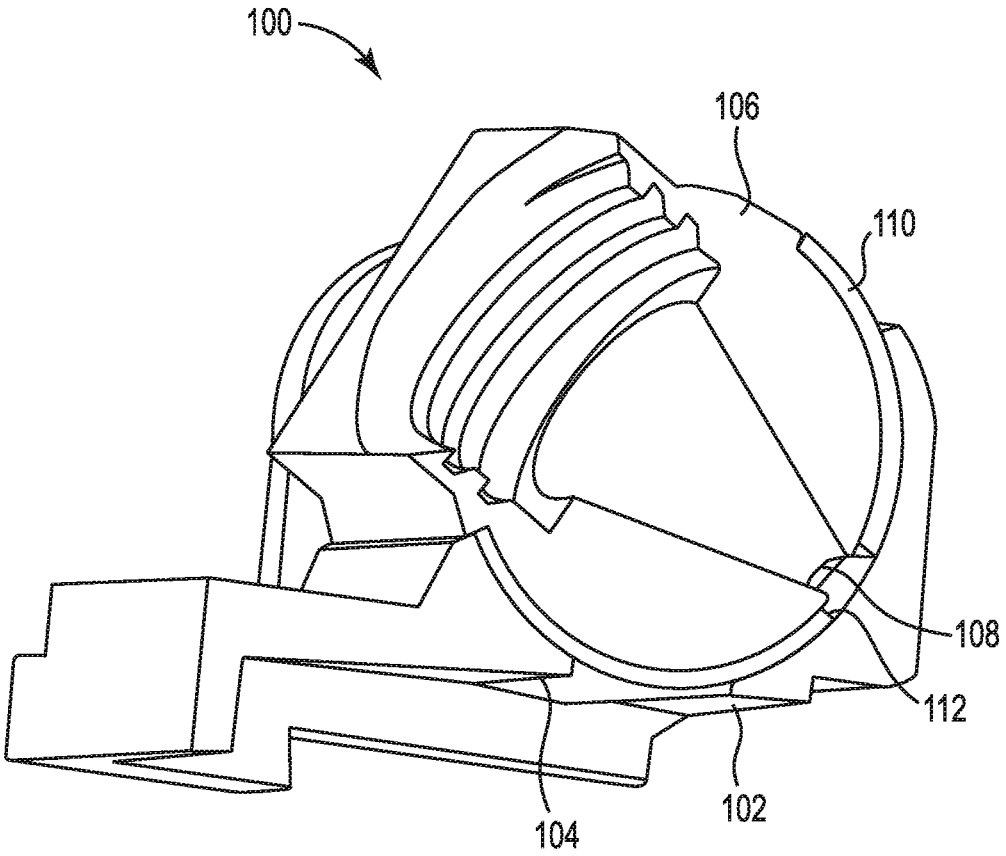
FIG. 1 illustrates an example of a system consistent with the disclosure.

FIG. 1 illustrates an example of a system 100 consistent with the disclosure. The system 100 may be implemented in a variety of imaging systems, such as printers, copiers, etc., for example. In some examples, the system 100 may include a valve body 102. In some examples, the valve body 102 may connect to a print substance container. As used herein, "print substance container" refers to a vessel, box, carton, or other suitable receptacle for the containment of a print substance for use during the printing process. The valve body 102 may connect with a print substance container to transfer print substance into the print substance container.

The valve body 102 may include a first opening 104. As used herein, "opening" refers to an aperture or gap allowing access though an object. In some examples, the first opening 104 of the valve body 102 may assist in the communication of print substance into a print substance container. That is, print substance may travel through the first opening 104 to refill a print substance container when the valve body 102 is connected to the print substance container. It should be understood that when an element is referred to as being "in contact," "connected to", or "coupled to" another element, it may be directly in contact, connected, or coupled with the other element or intervening elements may be present.

In some examples, the system 100 may include a print substance valve 106 disposed inside of the valve body 102. The print substance valve 106 may assist in the transferring of print substance into a print substance container. In addition, the print substance valve 106 may include a second opening 108 to communicate print substance into the print substance container. That is, print substance may travel through the second opening 108 and through the first opening 104 as print substance transitions into the print substance container. As used herein, "transition" refers to the process of changing from one state and/or position to another. In some examples, the first opening 104 of the valve body 102 may be substantially larger than the second opening 108 of the print substance valve 106 to prevent print substance residue from remaining on the valve body 102. That is, as print substance transitions through the second opening 108 of the print substance valve 106 into the first opening 104 the print substance may not come in contact with the sides of the valve body 102 that make up the first opening 104.

As used herein, the term substantially intends that the characteristic does not have to be absolute but is close enough so as to achieve the characteristic. For example, "substantially larger" is not limited to absolutely larger. For example, "substantially the same size" is not limited to exactly the same size. For example, "substantially aligned" is not limited to absolutely aligned. For example, "substantially offset" is not limited to absolutely offset.

In some examples, the system 100 may include a liner 110. The liner 110 may be coupled to the print substance valve 106. In addition, the liner 110 may be disposed inside of the valve body 102. The liner 110 may assist in the transferring of print substance into a print substance container. That is, the liner 110 may include a third opening 112 to allow print substance transition into the print substance container. For instance, print substance may travel through the first opening 104, the second opening 108, and the third opening 112 as print substance transitions into the print substance container.

In some examples, the third opening 112 of the liner 110 may be substantially the same size as the second opening 108 of the print substance valve 106. In contrast, the first opening 104 of the valve body 102 may be substantially larger than the third opening 112 of the liner 110 to prevent the transfer of print substance from remaining on the valve body 102 after the transfer of print substance is complete. That is, as print substance transitions through the second opening 108 and the third opening 112 into the first opening 104 the print substance may not come in contact with the sides of the valve body 102 that make up the first opening 104.

In some examples, the print substance valve 106 may transition the system 100 between an open position and a closed position. That is, as the print substance valve 106 transitions the system 100 moves between an open state and a closed state. System 100 of FIG. 1 illustrates the print substance valve 106 in a closed position. In some examples, the system 100 is in a closed position when the print substance valve 106 is in a closed position.

The print substance valve 106 transitions the liner 110 may transition with the print substance valve 106. For instance, the liner 110 may transition in the same direction as the print substance valve 106 as the print substance valve 106 transitions into a closed position or an open position. In some examples, the system 100 may be in a closed position if the second opening 108 of the print substance valve 106 is substantially offset with the first opening 104 of the valve body 102. That is, if the first opening 104 and the second opening 108 are not substantially aligned the system 100 may be in a closed position. As used herein, "offset" refers to an object and/or feature being out of line with another object and/or feature. Likewise, the system 100 may be in a closed position if the third opening 112 of the liner 110 is not substantially aligned and/or substantially offset with the first opening 104 of the valve body 102. As used herein, "aligned" refers to an object and/or feature being placed or arranged in a substantially straight line with another object and/or feature.

In addition, the system 100 may be in an open position if the second opening 108 of the print substance valve 106 is substantially aligned with the first opening 104 of the valve body 102. That is, if the first opening 104 and the second opening 108 are substantially aligned the system 100 may be in an open position. Likewise, the system 100 may be in an open position if the third opening 112 of the liner 110 is substantially aligned with the first opening 104 of the valve body 102. In some examples, the second opening 108 and the third opening 112 may be substantially aligned when the system 100 is in an open position and a closed position. In addition, the second opening 108 and the third opening 112 may be substantially aligned as the system transition between an open position and a closed position. For example, the print substance valve 106 and the liner 110 may move together as the system transitions between an open position and a closed position.

Figure 2:
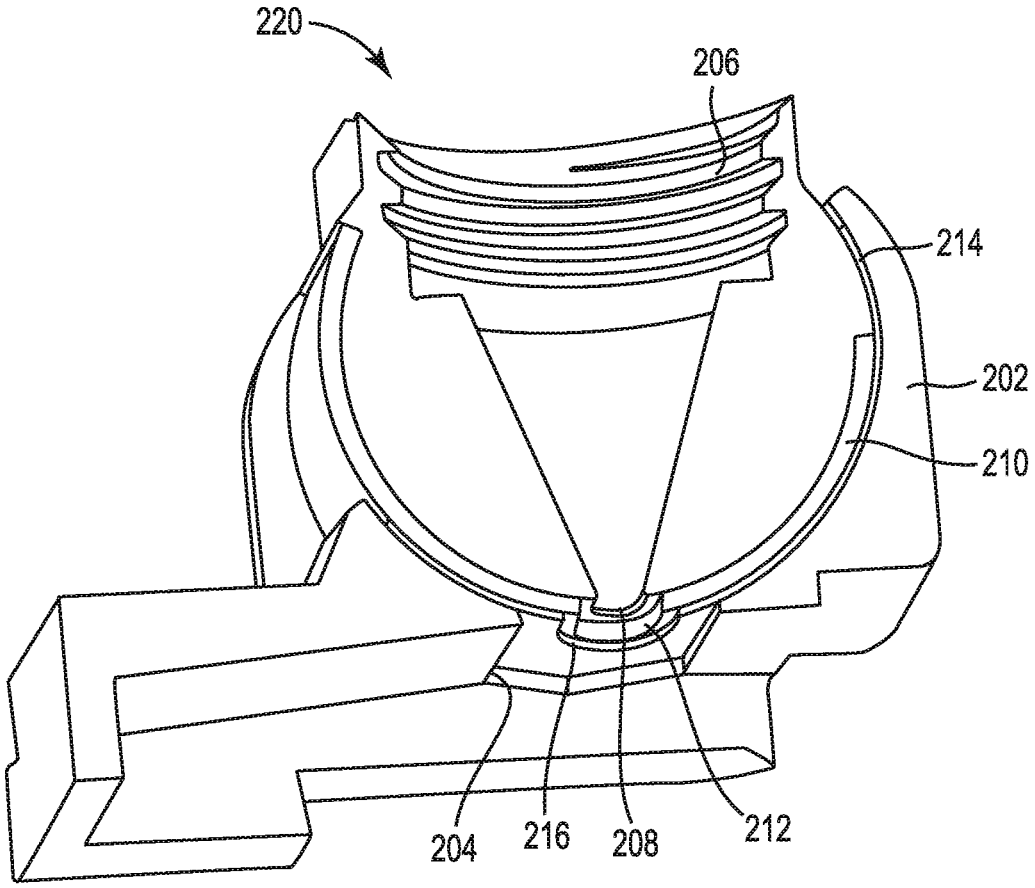
FIG. 2 illustrates an example of a print substance plug valve consistent with the disclosure.

FIG. 2 illustrates an example of a print substance plug valve 220 consistent with the disclosure. Valve body 202 is analogous or similar to valve body 102 of FIG. 1. Print substance valve 206 is analogous or similar to print substance valve 106 of FIG. 1. Liner 210 is analogous or similar to liner 110 of FIG. 1. First opening 204 is analogous or similar to first opening 104 of FIG. 1. Second opening 208 is analogous or similar to second opening 108 of FIG. 1. Third opening 212 is analogous or similar to third opening 112 of FIG. 1.

In some examples, the print substance plug valve 220 may include a valve body 202, a first opening 204, print substance valve 206, a second opening 208, a liner 210, and a third opening 212. In addition, the print substance plug valve 220 may include a plug output seat 214. The plug output seat 214 may assist in the transferring of print substance into a print substance container. The plug output seat 214 may include a fourth opening 216 to assist in the transferring and/or communication of print substance into a print substance container. For instance, print substance may travel through the first opening 204, the second opening 208, the third opening 212, and the fourth opening 216 as print substance is transferred into the print substance container.

In some examples, the fourth opening 216 of the plug output seat 214 may be substantially larger than the second opening 208 of the print substance valve 206. In addition, the fourth opening 216 of the plug output seat 214 may be substantially larger than the third opening 212 of the liner 210. In contrast, the fourth opening 216 of the plug output seat 214 may be substantially smaller than the first opening 204 of the valve body 202 to limit the amount of print substance remaining on the valve body 202 after the transfer of print substance.

In some examples, the plug output seat 214 may limit the amount of print substance residue remaining on the print substance plug valve 220 after the transfer or print substance. For instance, the plug output seat 214 may form a barrier that limits the amount of print substance left on the valve body 202 after the transfer of print substance into a print substance container. That is, as print substance is transferred through the second opening 208 of the print substance valve 206 into a print substance container the fourth opening 216 of the plug output seat 214 may confine the print substance to a set location limiting the amount of print substance residue left on the valve body 202. In some examples, print substance may cling to the plug output seat 214 and no other surface of the print substance plug valve 220.

In some examples, the plug output seat 214 may be a thin material with a thickness ranging from about 0.15 millimeters to about 0.25 millimeters (mm). For instance, in some examples, the thickness of the plug output seat 214 may ranging from about 0.15 mm to about 0.17 mm, 0.15 mm to about 0.18 mm, 0.15 mm to about 0.19 mm, 0.15 mm to about 0.20 mm, 0.15 mm to about 0.22 mm, 0.15 mm to about 0.23 mm, 0.15 mm to about 0.24 mm, 0.23 mm to about 0.25 mm, 0.21 mm to about 0.25 mm, 0.19 mm to about 0.25 mm, 0.18 mm to about 0.25 mm, 0.17 mm to about 0.25 mm, 0.16 mm to about 0.25 mm.

In some examples, the plug output seat 214 may be comprised of a thin stiff plastic. For example, the plug output seat 214 may be comprised of polyoxy methylene (POM), poly(methyl methacrylate) (PMMA), polyethylene terephthalate, polyvinyl chloride, carbon fiber, carbon fiber reinforced polymer (CFRP), glass-reinforced plastic (GRP), or a combination thereof, amongst other possibilities. However, this disclosure is not so limited. That is, in some examples, the plug output seat 214 may be comprised of a thin stiff metal. For instance, the plug output seat 214 may be comprised of steel, stainless steel, brass, aluminum, or a combination thereof, amongst other possibilities. In some examples, using a stiff material to form the plug output seat 214 may allow the other components (e.g., valve body 202, print substance valve 206, etc.) of the print substance plug valve 220 to be made of cheaper less expensive material.

In some examples, the plug output seat 214 may adjacent to the valve body 202. In addition, the plug output seat 214 may adjacent to the liner 210. That is, the plug output seat 214 may be positioned between the valve body 202 and the liner 210 to limit the amount of print substance left on the valve body 202 after the transfer of print substance into a print substance container. The plug output seat 214 may limit the amount of print substance residue on the valve body 202 as print substance is transferred through the print substance valve 206 into the print substance container. It should be understood that when an element is referred to as being "adjacent" to another element, it may be on, in contact, connected, next to, or coupled with the other element.

In some examples, the print substance valve 206 may transition the print substance plug valve 220 between an open position and a closed position. Print substance plug valve 220 of FIG. 2 illustrates the print substance valve 206 in an open position. In some examples, the print substance plug valve 220 is in an open position when the print substance valve 206 is in an open position. The plug output seat 214 may be stationary as the print substance valve 206 transitions between an open position and a closed position. Similarly, the valve body may be stationary as the print substance valve 206 transitions between an open position and a closed position.

In some examples, the fourth opening 216 of the plug output seat 214 may be substantially aligned with the first opening 204 of the valve body 202 when the print substance plug valve 220 is in an open position or a closed position. Further, the print substance plug valve 220 may be in a closed position if the fourth opening 216 of the plug output seat 214 is substantially offset with the second opening 208 of the print substance valve 206. In addition, the print substance plug valve 220 may be in a closed position if the fourth opening 216 of the plug output seat 214 is substantially offset with the third opening 212 of the liner 210. In contrast, the print substance plug valve 220 may be in an open position if the fourth opening 216 of the plug output seat 214 is substantially aligned with the first opening 204 of the valve body 202 and the second opening 208 of the print substance valve 206. In addition, the print substance plug valve 220 may be in an open position if the fourth opening 216 of the plug output seat 214 is substantially aligned with the third opening 212 of the liner 210.

In some examples, the liner 210 may clean the plug output seat 214 as the print substance plug valve 220 transitions between an open position and a closed position. For instance, as the print substance valve 206 and the liner 210 transition from an open position to a closed position the liner 210 may wipe the surface of the plug output seat 214 to clean the print substance remaining on the plug output seat 214 after the transfer of print substance is complete. Similarly, the liner 210 may wipe the plug output seat 214 cleaning the print substance residue as the print substance valve 206 transitions from a closed position to an open position. The liner 210 may limit the amount of print substance that is present on the print substance plug valve 220 after the transfer of print substance. That is, the liner 210 may wipe excess print substance from the print substance plug valve 220 after the transfer of print substance to limit the amount of print substance present on the print substance plug valve 220 after the transfer of print substance.

In some examples, the plug output seat 214 may mitigate the potential for trapped volume of print substance. For instance, the print substance may adhere to the plug output seat 214 as print substance is transferred to the print substance container and the liner 210 may wipe the print substance from the plug output seat 214 as the print substance valve 206 transitions into a closed position.

In some examples, the liner 210 may be comprised of a densely compacted fabric to wipe the print substance plug valve 220 as the print substance plug valve 220 transitions between an open position and a closed position. For example, the liner 210 may be comprised of cloth, felt, a variety of different textiles, or a combination thereof. However, this disclosure is not so limited. In some examples, the liner 210 may be comprised of a foam material to wipe the print substance plug valve 220 as the print substance plug valve 220 transitions between an open position and a closed position.

In some examples, the liner 210 may be a thin material with a thickness ranging from about 0.25 millimeters to about 3 millimeters (mm). For instance, in some examples, the thickness of the liner 210 may ranging from about 0.25 mm to about 0.5 mm, 0.25 mm to about 0.75 mm, 0.25 mm to about 1.0 mm, 0.25 mm to about 1.25 mm, 0.25 mm to about 1.5 mm, 0.25 mm to about 2.0 mm, 0.25 mm to about 2.5 mm, 0.3 mm to about 3.0 mm, 0.7 mm to about 3.0 mm, 0.9 mm to about 3.0 mm, 1.1 mm to about 3.0 mm, 1.3 mm to about 3.0 mm, 1.7 mm to about 3.0 mm, 1.9 mm to about 3.0 mm, 2.1 mm to about 3.0 mm, 2.3 mm to about 3.0 mm, and 2.7 mm to about 3.0 mm.

In some examples, the liner 210 may form a seal between the print substance valve 206 and the plug output seat 214. That is, the liner 210 may prevent print substance from entering other components of the print substance plug valve 220. The liner 210 may reduce the amount of print substance contamination during the transfer of print substance into the print substance container. For instance, the liner 210 may wipe from the plug output seat 214 as the print substance plug valve 220 transitions into a closed position. In some examples, wiping the plug output seat 214 and/or the print substance plug valve 220 may ensure that print substance left on the plug output seat 214 and/or the print substance plug valve 220 does not enter the print substance container.

Figure 3:
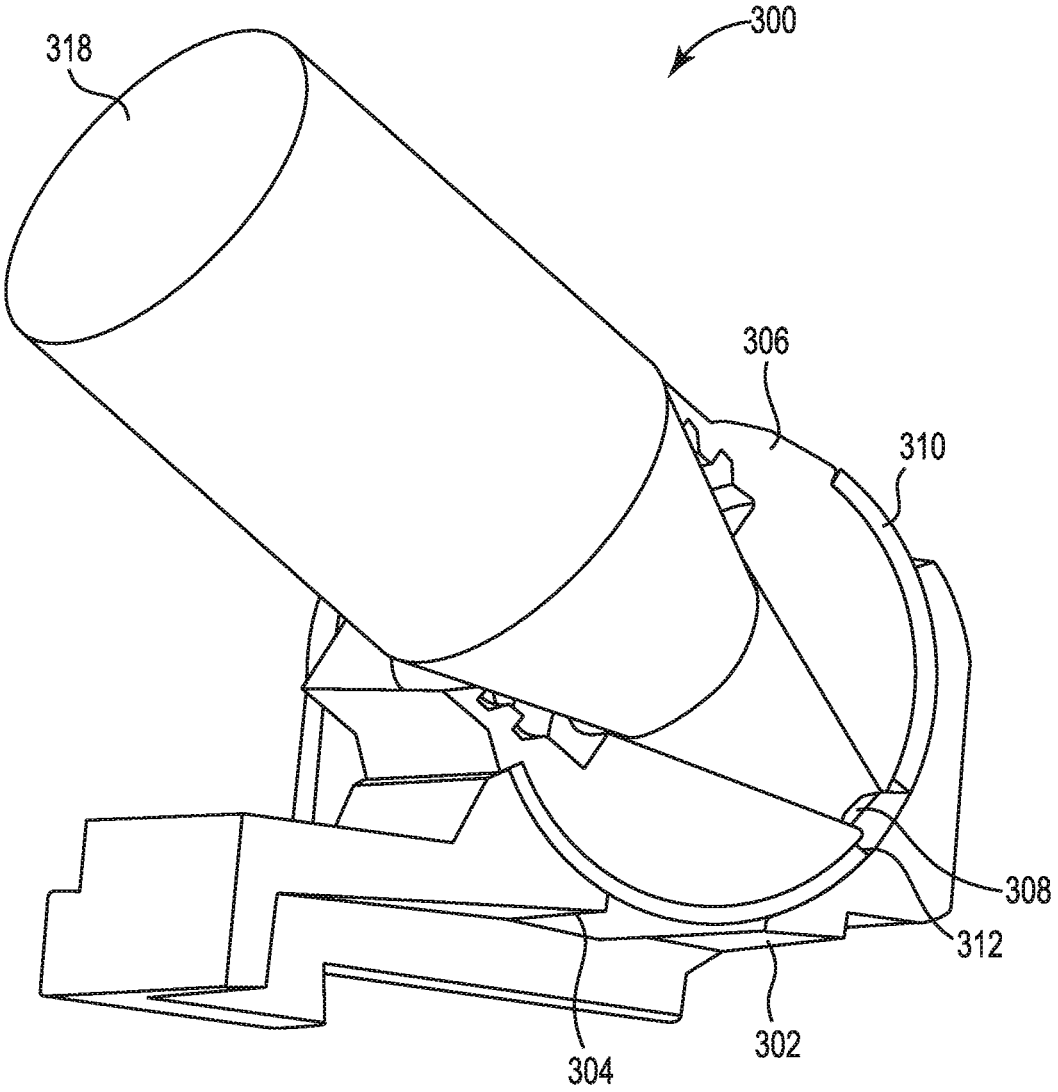
FIG. 3 illustrates an example of system consistent with the disclosure.

FIG. 3 illustrates an example of system 300 consistent with the disclosure. System 300 is analogous or similar to system 100 of FIG. 1. Valve body 302 is analogous or similar to valve body 102 and 202 of FIGS. 1 and 2, respectively. Print substance valve 306 is analogous or similar to print substance valve 106 and 206 of FIGS. 1 and 2, respectively. Liner 310 is analogous or similar to liner 110 and 210 of FIGS. 1 and 2, respectively. First opening 304 is analogous or similar to first opening 104 and 204 of FIGS. 1 and 2, respectively. Second opening 308 is analogous or similar to second opening 108 and 208 of FIGS. 1 and 2, respectively. Third opening 312 is analogous or similar to third opening 112 and 212 of FIGS. 1 and 2, respectively.

In some examples, the system 300 may include a valve body 302, a first opening 304, print substance valve 306, a second opening 308. In addition, the system 300 may include refill container 318. The refill container 318 may contain print substance to assist in the transfer of print substance into a print substance container.

For examples, the refill container 318 may be connected to the print substance valve 306. In some examples, the refill container 318 may be permanently connected to the print substance valve 306. That it, once the print substance in the refill container 318 is finished the system 300 may not be used to refill the print substance cartridge. The refill container 318 may be used a limited number of times. However, this disclosure is not so limited. In some examples, the refill container 318 may be removably connected to the print substance valve 306. That it, once the print substance in the refill container 318 is finished the refill container 318 may be removed and a new unused refill container 318 may be added to the system 300. The system 300 may be continuously used to refill the print substance cartridge as long as the refill container 318 is replaced.

In some examples, the system may include a liner 310 including a third opening 312. In some examples, the liner 310 may clean the valve body 302 as the system 300 transitions between an open position and a closed position. For instance, as the print substance valve 306 and the liner 310 transition from an open position to a closed position the liner 310 may wipe the surface of the valve body 302 to clean the print substance remaining on the valve body 302 after the transfer of print substance is complete. Similarly, the liner 310 may wipe the valve body 302 cleaning the print substance residue as the print substance valve 306 transitions from a closed position to an open position. The liner 310 may limit the amount of print substance present in the system 300 after the transfer of print substance. For instance, the liner 310 may wipe excess print substance from the system 300 after the transfer of print substance to reduce the amount of print substance present in the system 300 after the transfer of print substance. In addition, the liner 310 may reduce the amount of contaminated print substance in the system 300 by cleaning the valve body 302 as the system 300 transitions between an open position and a closed position.

In some examples, the liner 310 may form a seal between the print substance valve 306 and the valve body 302. That is, the liner 310 may prevent print substance from entering other components of the system 300. In addition, the liner 310 may prevent excess print substance from leaving the system 300.

Figure 4:
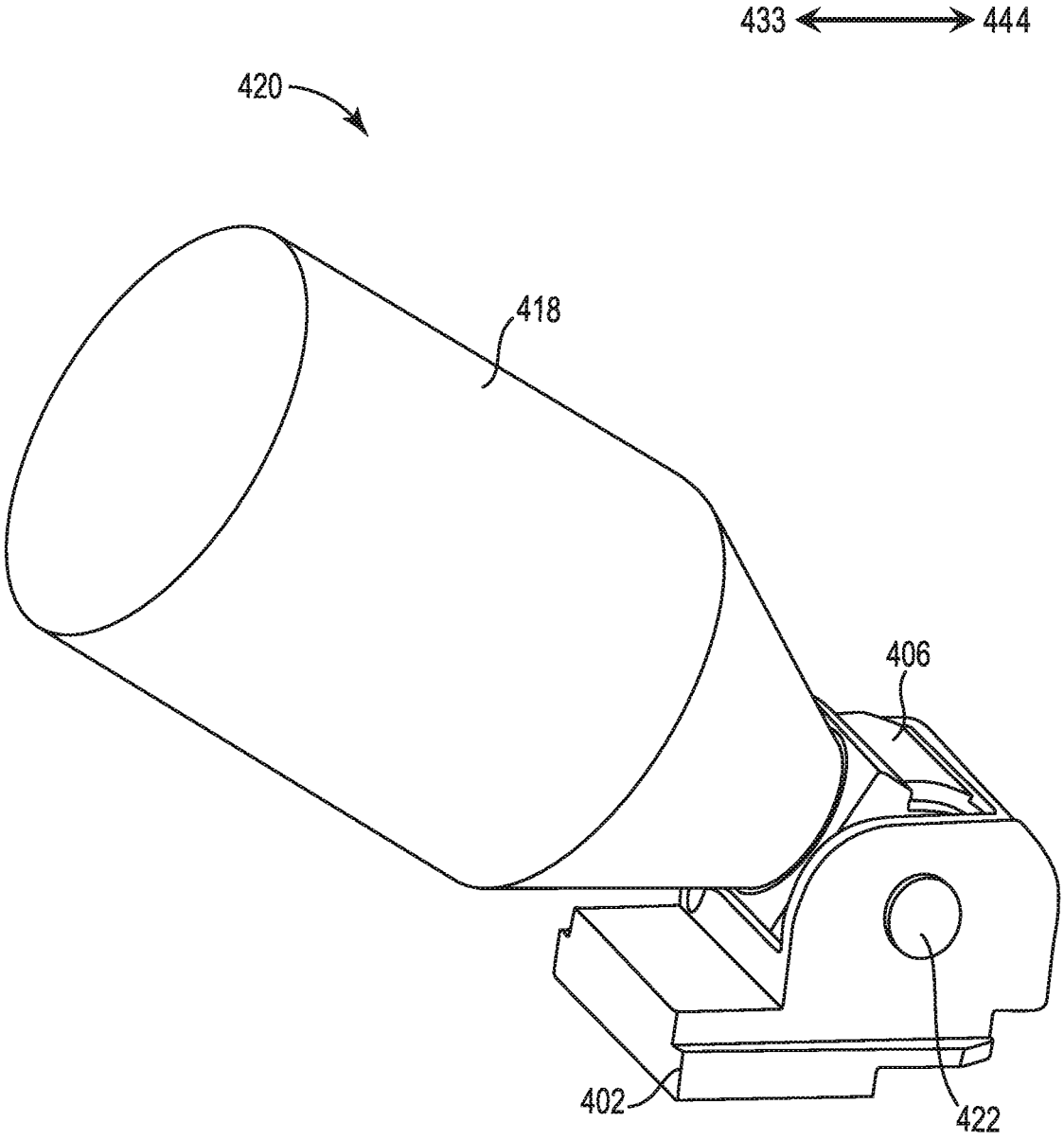
FIG. 4 illustrates an example of a print substance plug valve consistent with the disclosure.

FIG. 4 illustrates an example of a print substance plug valve 420 consistent with the disclosure. Print substance plug valve 420 is analogous or similar to print substance plug valve 220 of FIG. 2. Valve body 402 is analogous or similar to valve body 102, 202 and 302 of FIGS. 1, 2, and 3, respectively. Print substance valve 406 is analogous or similar to print substance valve 106, 206, and 306 of FIGS. 1, 2, and 3, respectively. Refill container 418 is analogous or similar to refill container 318 of FIG. 3.

In some examples, the print substance plug valve 420 may include a valve body 402, print substance valve 406, and a refill container 418. In addition, the print substance plug valve 420 may include an axis pin 422 coupled to the valve body 402. The axis pin 422 may connect to the print substance valve 406 to allow the print substance to rotate about the axis pin 422 and transition the print substance plug valve 420 between an open position. For example, the print substance valve 406 may rotate in a direction as denoted by arrow 444 to transition the print substance plug valve 420 into an open position. In some examples, the print substance plug valve 420 is in an open position when the openings (e.g., first opening 204, second opening 208, third opening 212, and/or fourth opening 216 of FIG. 2) of the print substance plug valve 420 are substantially aligned.

In some examples, the print substance valve 406 may be adjacent to a liner (e.g., liner 210 of FIG. 2). The liner adjacent to the print substance valve 406 may rotate in the same direction (e.g., a direction denoted by the arrows 433 and 444) and the same distance as the print substance valve 406 to transition the print substance plug valve 420 into an open position or a closed position.

In addition, the axis pin 422 may connect to the print substance valve 406 to allow the print substance valve 406 to rotate about the axis pin 422 and transition the print substance plug valve 420 between a closed position. For example, the print substance valve 406 may rotate in a direction as denoted by arrow 433 to transition the print substance plug valve 420 into a closed position. In some examples, the print substance plug valve 420 is in a closed position when the first opening and the second opening of the print substance plug valve 420 are substantially offset.

Figure 5:
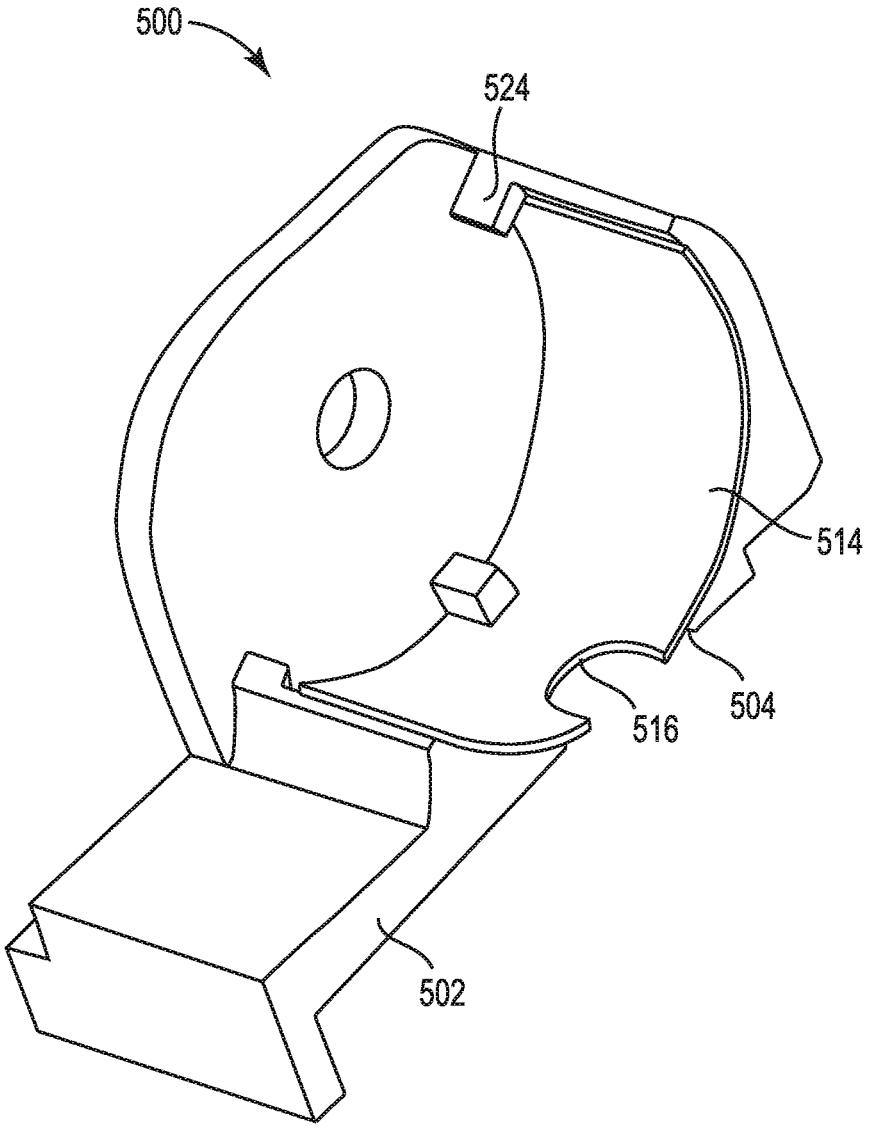
FIG. 5 illustrates an example of a system consistent with the disclosure.

FIG. 5 illustrates an example of a system 500 consistent with the disclosure. System 500 is analogous or similar to system 100 and 300 of FIGS. 1 and 3, respectively. Valve body 502 is analogous or similar to valve body 102, 202, 302, and 402 of FIGS. 1, 2, 3, and 4, respectively. Plug output seat 414 is analogous or similar to plug output seat 214 of FIG. 2. First opening 504 is analogous or similar to first opening 104, 204, and 304 of FIGS. 1, 2, and 3, respectively. Fourth opening 516 is analogous or similar to second opening 216 of FIG. 2.

In some examples, the system 500 may include a valve body 502 including a first opening 504. The valve body 502 may house a print substance valve (e.g., print substance valve 406 of FIG. 4), a liner (e.g., liner 310 of FIG. 3), and a plug output seat 514 including a fourth opening 516. In some examples, the valve body 502 may include a retention mechanism 524 to hold the plug output seat 514 in place. In some examples, the valve body 502 may include a plurality of retention mechanism. That is, the plug output seat 514 may be fixed into a set position of the valve body 502. For instance, the plug output seat 514 may be stationary as the system 500 rotates between an open position and a closed position. In some examples, the plug output seat 514 may be curved to allow the print substance valve to rotate between an open position and a closed position.

The figures herein follow a numbering convention in which the first digit corresponds to the drawing figure number and the remaining digits identify an element or component in the drawing. Elements shown in the various figures herein may be capable of being added, exchanged, and/or eliminated so as to provide a number of additional examples of the disclosure. In addition, the proportion and the relative scale of the elements provided in the figures are intended to illustrate the examples of the disclosure and should not be taken in a limiting sense.

It should be understood that the descriptions of various examples may not be drawn to scale and thus, the descriptions may have a different size and/or configuration other than as shown therein.

What is claimed:

1. A system comprising:

a valve body having a first opening;

a print substance valve disposed inside of the valve body including a second opening; and a liner coupled to the print substance valve including a third opening, wherein the liner is to clean print substance, when present, from the system responsive to the transition of the system into either of a closed position or an open position.

2. The system of claim 1, wherein the second opening is substantially a same size as the third opening.

3. The system of claim 2, wherein the first opening is larger than the second opening and the third opening.

4. The system of claim 1, wherein the liner is to transition in a same direction as the print substance valve responsive to the transition of the system into either of the closed position or the open position.

5. The system of claim 1, wherein the first opening is substantially aligned with the second opening and the third opening when the system is in the open position.

6. The system of claim 5, wherein the first opening is substantially offset from the second opening when the system is in the closed position.

7. The system of claim 1, wherein the second opening and the third opening are substantially aligned when the system is in either of the closed position and the open position.

8. A print substance plug valve comprising:

a valve body having a first opening;

a print substance valve including a second opening;

a liner adjacent to the print substance valve having a third opening substantially a same size as the second opening; and a plug output seat positioned between the valve body and the liner including a fourth opening larger than either of the second opening and third opening.

9. The print substance plug valve of claim 8, wherein the first opening and the fourth opening are substantially aligned when the print substance plug valve is in a closed position or an open position.

10. The print substance plug valve of claim 8, further comprising a removable refill container attached to the print substance valve.

11. The print substance plug valve of claim 8, wherein the plug output seat is comprised of a plastic, wherein the plastic further comprised of polyoxy methylene (POM), poly(methyl methacrylate) (PMMA), polyethylene terephthalate, polyvinyl chloride, carbon fiber, carbon fiber reinforced polymer (CFRP), glass-reinforced plastic (GRP), or a combination thereof.

12. A system comprising:

a valve body to house a print substance valve:

the print substance valve to rotate between either of a closed position or an open position;

a liner adjacent to the print substance valve to rotate with the print substance valve, wherein the liner is to rotate in a same direction and a same distance as the print substance valve; and a refill container attached to the print substance valve.

13. The system of claim 12, further including a plug output seat positioned between the valve body and the liner.

14. The system of claim 13, wherein the plug output seat is comprised of a metal, wherein the metal further comprised of steel, stainless steel, brass, aluminum, or a combination thereof.

15. The system of claim 12, further comprising an axis pin, wherein the print substance valve is to rotate about the axis pin to transition the print substance valve into either of the closed position or the open position.

* * * * *